United States Patent [19]

Fujita et al.

[11] Patent Number: 4,519,668

[45] Date of Patent: May 28, 1985

[54] WIRE TERMINAL CONNECTOR

[75] Inventors: Teizo Fujita, Ibaraki; Yoshitaka Tsuji, Toyonaka, both of Japan

[73] Assignee: Idec Izumi Corporation, Osaka, Japan

[21] Appl. No.: 555,728

[22] Filed: Nov. 28, 1983

[30] Foreign Application Priority Data

Nov. 29, 1982 [JP] Japan ..... 57-210447
Nov. 29, 1982 [JP] Japan ..... 57-210448

[51] Int. Cl.[3] ..... H01R 13/11

[52] U.S. Cl. ..... 339/241; 339/255 R; 339/263 R

[58] Field of Search ..... 339/263, 272, 246, 248, 339/255, 259, 198 R, 249 A, 241

[56] References Cited

U.S. PATENT DOCUMENTS

| | | | |
|---|---|---|---|
| 2,092,372 | 9/1937 | Goeller | 339/249 A |
| 2,231,325 | 2/1941 | Douglas | 339/263 R |
| 3,083,348 | 3/1963 | Crouther | 339/263 R |
| 3,335,399 | 8/1967 | Rys | 339/272 UC |
| 3,423,723 | 1/1969 | Kobryner | 339/272 A |
| 3,793,607 | 2/1974 | Smith et al. | 339/263 R |
| 3,803,536 | 4/1974 | Becker | 339/263 R |
| 4,136,924 | 1/1979 | Dobrosielski | 339/263 R |

FOREIGN PATENT DOCUMENTS

| | | | |
|---|---|---|---|
| 1498865 | 11/1967 | France | 339/263 R |

*Primary Examiner*—Gil Weidenfeld
*Assistant Examiner*—David L. Pirlot
*Attorney, Agent, or Firm*—Pollock, Vande Sande & Priddy

[57] ABSTRACT

Disclosed is a wire terminal connector for use in an electric device, comprising an electrically conductive terminal plate formed with at least one screw hole, and at least one terminal screw to be screwed into the screw hole, for fixing a wire terminal between the terminal plate and the terminal screw, in which the terminal connector further comprises: a movable electrically conductive member slidably supported perpendicularly to the terminal plate, the movable member including a first portion extending parallel with the terminal plate and supporting the terminal screw, and a second portion integrally formed with the first portion and extending perpendicularly to the first portion from one end of the first portion, the second portion being formed with a rectangular stopper portion for restricting a range of movement of the first portion; a compression spring with its one end supported by the second portion of the movable member; and a fixed spring-support portion for supporting the compression spring at the other end thereof so that the terminal screw is stably held at a selected one of at least two, a first and a second, stable positions, the first and second positions having the largest and smallest distances from the terminal plate respectively.

13 Claims, 10 Drawing Figures

WIRE TERMINAL CONNECTOR

The invention relates to wire terminal connectors for use in electric devices such as sockets, switches, terminal blocks, etc.

Conventionally, when a wire end provided with a pressure or solderless terminal is connected to a wire terminal connecting portion of an electric device, it is necessary that a terminal screw is once removed from a terminal plate and then screwed into the terminal plate again after the solderless terminal has been placed on the terminal plate. Further, also when the solderless terminal is removed from the wire terminal connecting portion, it is necessary to once remove the screw from the terminal plate. Thus, not only the work is very troublesome but there is a possibility that terminal screws may be lost in the working of connecting-/removing the terminal screws to/from an electric device.

To prevent terminal screws from being lost, such an arrangement of a wire terminal connecting device has been proposed, in which a movable member supporting a terminal screw for fixing a wire terminal is provided such that the movable member is slidably supported to intersect a terminal plate and always outwardly urged by such as a coiled spring.

Such a device employing such as a coiled spling, however, has a disadvantage that it is necessary to fix the wire while pressing a terminal screw against the return force of the coiled spring when the terminal screw is screwed into a screw hole of the terminal plate because a movable member supporting the terminal screw always outwardly urges the terminal screw, and working is very troublesome when numbers of terminal connecting devices are collectively arranged in one place because each of wire terminals has to be separately screwed against the spring force.

An object of the present invention is to eliminate the disadvantages in the prior art.

Another object of the present invention is to provide a wire terminal connector in which a terminal screw can be prevented from being lost and the wire connecting/removing work can be easily and surely performed.

To attain the above-mentioned objects, according to the present invention, the wire terminal connector for use in an electric device comprising an electrically conductive terminal plate formed with at least one screw hole, and at least one terminal screw to be screwed into the screw hole, for fixing a wire terminal between the terminal plate and the terminal screw, is featured in that it further comprises an electrically conductive movable member slidably supported perpendicularly to said terminal plate, the movable member including a first portion extending parallelly with the terminal plate and supporting the terminal screw, and a second portion integrally formed with the first portion and extending perpendicularly to the first portion from one end of the first portion, the second portion being formed with a rectangular stopper portion for restricting a range of movement of the first portion; a compression spring with its one end supported by the second portion of the movable member; and a fixed spring-support portion for supporting the compression spring at the other end thereof so that the terminal screw is stably held at a selected one of at least two, a first and a second, stable positions, the first and second positions having the largest and smallest distances from the terminal plate respectively.

The above and other objects, features and advantages of the present invention will be appararent from the following detailed description of preferred embodiments thereof taken in conjunction with the accompanying drawings, in which.

Figure 1:
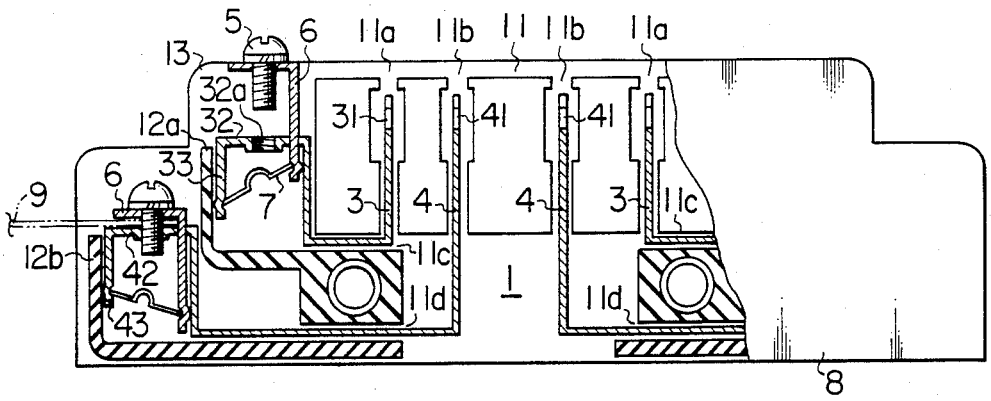
FIG. 1 is a front view, partly in section, showing a wire terminal connector in the form of a socket to which a first embodiment of the present invention is applied.
Figure 4:
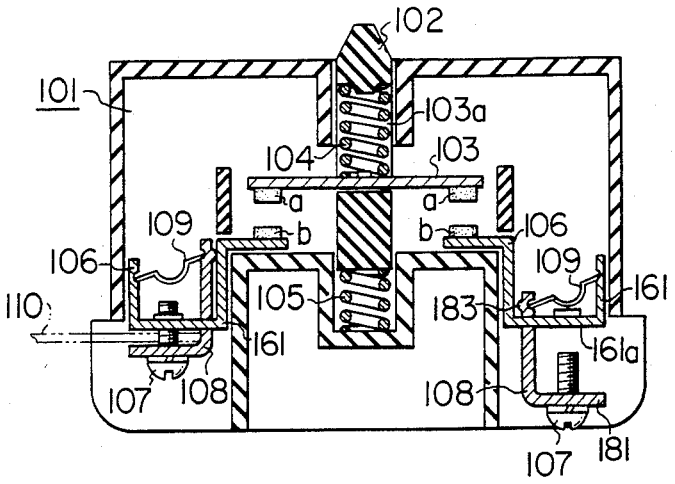
Figure 5:
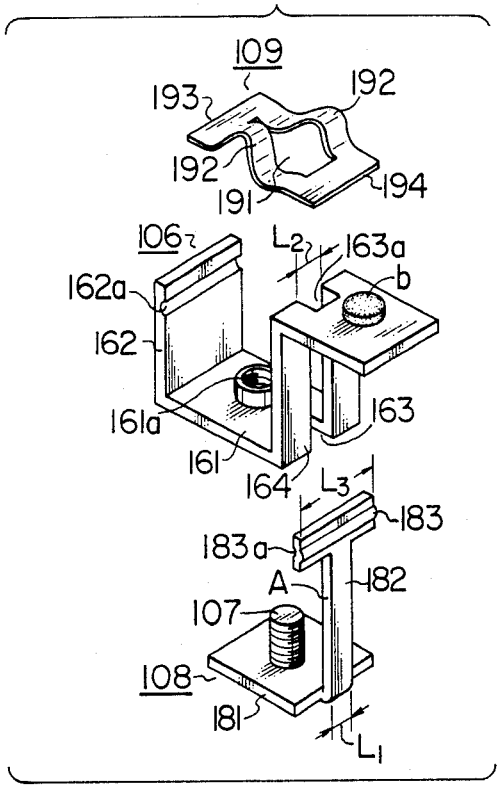
Figure 7:
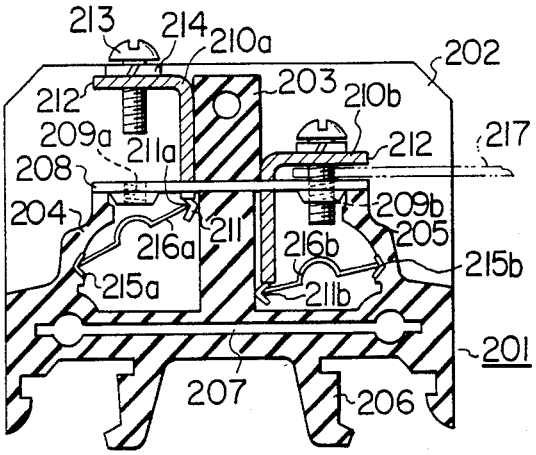
Figure 8:
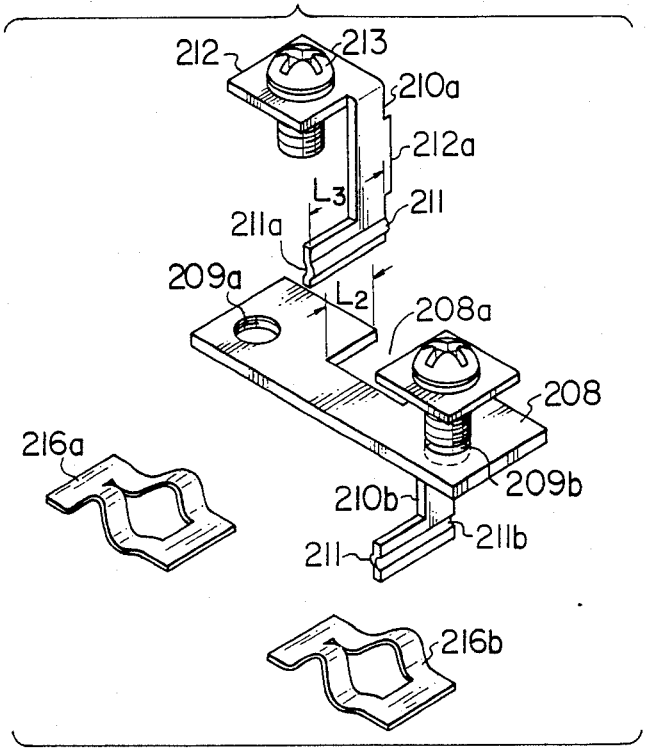

FIGS. 3(*a*) and 3(*b*) are diagrams for explaining the operation of the wire terminal connector of FIG. 1;

FIG. 4 is a front view, partly in section, showing a wire terminal connector of in the form of a switch to which a second embodiment of the present invention is applied;

FIG. 5 is an exploded perspective view of a main part of the wire terminal connector of FIG. 4;

FIG. 6(*a*) and 6(*b*) are diagrams for explaining the operation of the wire terminal connector of FIG. 4;

FIG. 7 is a front view, partly in section, showing a wire terminal connector in the form of a terminal block to which a third embodiment of the present invention is applied; and FIG. 8 is an exploded perspective view of a main part of the wire terminal connector of FIG. 7.

Referring to the drawings, preferred embodiments of the present invention will be described hereunder.

Figure 2:
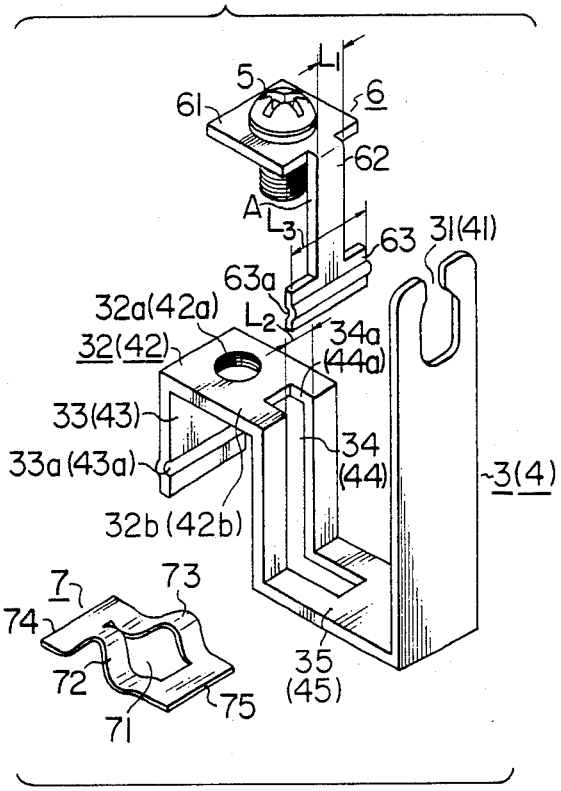
FIG. 2 is an exploded perspective view of a main part of the wire terminal connector of FIG. 1.

Referring now to FIGS. 1 to 3, a socket unit 1 has a base 11 at its center portion. Terminal pedestals 12*a* and 12*b* are stepwise formed at each of the longitudinal opposite ends of the base 11 and a separation wall is provided behind the terminal pedestals 12*a* and 12*b* stepwise in accordance with the respective heights of the terminal pedestals 12*a* and 12*b*. Holes 11*a*, 11*a*, 11*b*, 11*b* are collectively formed in the base 11 at its front side for the purpose of insertion of plugs of an external device such as a relay, a timer, etc. (not shown). The hole 11*a* and the terminal pedestal 12*a* provided at the upper stage of each end of the base 11 are communicated with each other through a hole 11*c* connecting the bottom of the hole 11*a* and the upper surface of the terminal pedestal 12*a*. Similarly to this, the hole 11*b* and the terminal pedestal 12*b* provided at the lower stage of each end of the base 11 are communicated with each other through a hole 11*d* connecting the bottom of the hole 11*b* and the upper surface of the terminal pedestal 12*b*. Thus, the holes 11*a*, 11*b*, and the 11*c*, 11*d* are opened at the front side of the base 11. Metal connecting members 3 and 4 respectively have plug receiving terminal portions 31 and 41 at their one ends and terminal plate portions 32 and 42 and at their other ends. The plug receiving terminal portions 31 and 41 are inserted into the holes 11*a* and 11*b* respectively, and the terminal plate portions 32 and 42 are disposed on the terminal pedestals 12*a* and 12*b* respectively. The terminal plate portions 32 and 42 respectively have first or horizontal portions 32*b* and 42*b*, second or vertical portions 33 and 43, and third or L-shaped portions 35 and 45 continued to the plug receiving terminal portions 31 and 41. The first or horizontal portions 32*b* and 42*b* are formed with screw holes 32*a* and 42*a* at their center portions, respectively, into which terminal screws 5 and 5 are to be screwed. Depressions or fixed spring-support V-shaped portions 33*a* and 43*a* are formed at the lower end portions of the second or vertical portions 33 and 43 respectively. A slot 34 (44) is formed continuously in the first or horizontal portion 32*b* (42*b*) and the third or L-shaped portion 35 (45) for the purpose of insertion and guide of a movable member 6.

The movable member 6 may be made of an electrically conductive or an electrically insulating material and has a substantially L-shaped cross-section. That is, the movable member 6 has a first or head portion 61 extending in parallel with the first or horizontal portion 32*b* (42*b*) of the terminal plate portion 32 (42) of the connecting member 3 (4) and a second or vertical portion 62 perpendicularly extending from one end of the first or head portion 61. The terminal screw 5 has a removal preventing portion (not shown) and is attached through the first or head portion 61. The width L1 of the second or vertical portion 62 is selected to be somewhat smaller than the width L2 of the slot 34 (44) to allow the movable member 6 to be vertically slidable in the slot 34 (44). A rectangular stopper portion 63 is formed at the lower end of the second or vertical portion 62 and a movable spring-support V-shaped portion 63*a* is formed by depressing the inner wall of the stopper portion 63. The horizontal length L3 of the stopper portion 63 is selected to be larger than the width L2 of the slot 34 (44) so that the stopper portion 63 can be into contact with the under surface of the first or horizontal portion 32*b* (42*b*) of the terminal plate portion 32 (42) to thereby restrict the upward movement of the movable member 6.

A compression spring 7 is formed from a rectangular piece of plate such that a window 71 is formed at its central portion and the opposite sides of the window are formed into a peak and a valley. The compression spring 7 is held between the fixed spring-support portion 33*a* (43*a*) and the movable spring-support portions 63*a* and 63*a*.

The attachment of the movable member 6 to the connecting member 3 (4) will be described hereunder under the condition that the side surfaces A are in opposite to the side walls of the slot 34 (44), by referring to FIG. 2. The movable member 6 is rotated clockwise by about 90 degrees with tne screw 5 as the center of rotation, inserted into rhe slot 34 (44), and then reversely rotated into the initial state. After thus attached, the movable member 6 is supported vertically movably along the inner side surfaces of the slot portion 34*a* (44*a*) in the first or horizontal portion 32*b* (42*b*) of the terminal plate portion 32 (42) and prevented from being removed from the connecting member 3 (4) by the stopper portion 63.

A desired number of the thus arranged plural socket units 1 are collectively integrated with each other to form a socket with the respective front opening sides disposed at the same side. The side of the socket unit 1 disposed at the end of the row of socket units is closed by an end plate 8 to complete a socket.

The work of connecting a wire terminal to the thus arranged socket according to the embodiment of the present invention will be now described. The terminal pedestal 12*a* on the left upper stage in FIG. 1 is in the state in which no wire terminal has been connected thereto. The movable member 6 is in the upper limit position, in which the stopper portion 63 is in contact with the terminal plate portion 32, due to the restoration force of tne spring 7, and the terminal screw 5 is prevented from removing from the first or head portion 61 of the movable member 6 so that the tip end of the screw 5 is opposed to the screw hole 32*a*. The terminal pedestal 12*b* on the left lower stage in FIG. 1 is in the stage where a wire terminal 9 has been already connected thereto. The movable member 6 has been lowered to its lowered position so that the wire 9 is sandwiched between the terminal plate portion 42*b* and the head portion 61.

Figure 3A:
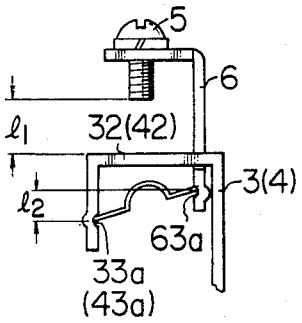
Figure 3B:
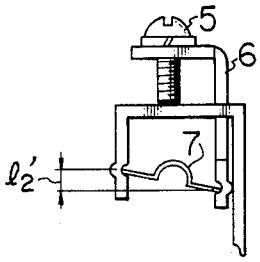

The embodiment according to the present invention is featured in that the position of the movable member 6 may change between two states depending on the length of the screw 5 or the height of the fixed spring-support portion 33*a* (43*a*) under the condition that the movable member 6 is not fastened by the screw 5, with the same shape and the same dimension of the movable member 6. That is, as shown in FIG. 3*a*, the terminal screw 5 is stably held at the upper limit position with the distance l1 between the tip end of the screw 5 and the upper surface of the first or horizontal portion 32*b* (42*b*) of the terminal plate portion 32 (42) and with the vertical length l2 of the spring 7, that is the distance in one direction from the fixed spring-support portion 33*a* (43*a*) to the movable spring-support portion 63*a*. Further, as shown in FIG. 3*b*, the terminal screw 5 is stably held at the lowered position with no space between the tip end of the screw 5 and the upper surface of the first or terminal plate portion 32*b* (42*b*) of the terminal plate portion 32*b* (42*b*) and with the vertical length l2′ of the spring 7, that is the vertical distance in the other direction from the fixed spring-support portion 33*a* (43*a*) to the movable spring-support portion 63*a*. A neutral point in which the horizontal length of the spring 7 is the shortest, that is the vertical distance between the fixed spring-support portion 33*a* (43*a*) and the movable spring-support portion 63*a* is zero, exists between the upper limit position and the lowered position of the terminal screw 5. When the movable member is in a position above this neutral position, upward force acts onto the movable member 6 by the spring 7, while when it is at a position under the neutral position, downward force acts onto the same by the spring 7.

Accordingly, in use, the worker pulls up first the movable member 6 to place it into the state of FIG. 3*a* to insert a wire terminal thereto. Then, the movable member 6 is pushed down to be placed into the lowered position of FIG. 3*b* in which the restoration force of the spring 7 acts onto the wire terminal in the direction to sandwich the wire terminal so that the screw 5 can be readily screwed by the worker without requiring any force against the force of the spring 7, and in which the force of the spring 7 continuously acts onto the screw in the direction of screwing the latter during the screwing operation, so that there is no possibility of coming-off of the screw due to vibrations, etc.

Referring to FIGS. 4 to 6, another embodiment will now be described in which the present invention is applied to a switch. In a push button switch body 101, a supporter 102 movably support a movable contactor 103 through a window 103*a* with a pressing spring 104. Movable contacts a and a are attached onto the movable contactor 103 at its opposite ends, and a spring 105 urges upward the supporter 102. A pair of fixed contactors 106 and 106 provided with fixed contacts b and b at their one ends respectively are fixed at the lower symmetrical portion of the switch body 101 such that the fixed contacts b and b are opposed to the movable contacts a and a. Each of the fixed contactors 106 and 106 has a first or horizontal portion 161 which acts as a terminal plate portion, a second or vertical portion 162 perpendicularly extending from one end of the terminal plate portion 161, and a third or L-shaped portion 164 formed at the other end of the first or terminal plate portion 161. The fixed contact b is attached onto the free end portion of the horizontal half of the L-shaped portion 164. A screw hole 161*a* into which a terminal screw 107 be screwed is formed in the terminal plate portion 161 substantially at the center thereof. A fixed spring-support V-shaped portion 162*a* is formed by depressing the inner wall portion at the free end of the vertical portion 162. A slot 163 is formed continuously in the first or terminal plate portion 161 and the third or L-shaped portion 164 of the fixed contactor 106 for the purpose of insertion and guide of a movable member 108.

The movable member 108 is made of an electrical material and has a substantially L-shaped cross-section. That is, the movable member 108 has a first or head portion 181 extending in parallel with the first or terminal plate portion 161 of the fixed contactor 106 and a second or vertical portion 182 perpendicularly extending from one end of the first or head portion 181. The terminal screw 107 has a removal preventing portion (not shown) and attached through the first or head portion 181. The width L1 of the second or vertical portion 182 is selected to be somewhat smaller than the width L2 of the slot 163 to allow the movable member 108 to be vertically slidable in the slot 163. A rectangular stopper portion 183 is formed at the lower end of the second or vertical portion 182 and a movable spring-support V-shaped portion 183*a* is formed by depressing the inner wall of the stopper portion 183. The horizontal length L3 of the stopper portion 183 is selected to be larger than the width L2 of the slot 163 so that the stopper portion 183 can be into contact with the inner or upper surface of the first or terminal plate portion 161 to thereby restrict the downward movement of the movable member 108 in the drawing.

A compression spring 109 is formed from a rectangular piece of plate such that a window 191 is formed at its central portion and the opposite sides of the window 191 are formed into a peak and a valley. The compression spring 109 is held between the fixed spring-support portion 162*a* and the movable spring-support portions 183*a*.

The attachment of the movable member 108 to the fixed contactor 106 will be described hereunder under the condition that the side surfaces A are in opposite to the side walls of the slot 163, by referring to FIG. 5. The movable member 108 is rotated clockwise by about 90 degrees with the terminal screw 107 as the center of rotation, inserted into the slot 163, and then reversely rotated into the initial state. After thus attached, the movable member 108 is supported vertically movable along the inner side surfaces of the slot portion 163 in the first or terminal plate portion 161, and prevented from being removed from the contactor 106 by the stopper portion 183.

The work of connecting a wire terminal to the thus arranged switch according to the second embodiment of the present invention will be now described. The terminal plate portion 161 at the right side in FIG. 4 is in the state in which no wire terminal has been connected thereto. The movable member 108 is in the lower limit position, in which the stopper portion 183 is in contact with the terminal plate portion 161, due to the restoration force of the spring 109, and in which the terminal screw 107 is prevented from removing from the first or head portion 181 of the movable member 108 and the tip end of the terminal screw 107 is opposed to the screw hole 161*a*. The terminal plate portion 161 at the left side in FIG. 4 is in the state where a wire terminal 110 has been connected thereto. The movable member 108 has been placed in its lift-up position so that the wire terminal 110 is sandwiched between the terminal plate portion 161 and the head portion 181.

Figure 6A:
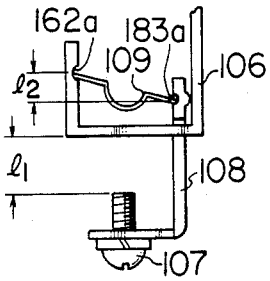
Figure 6B:
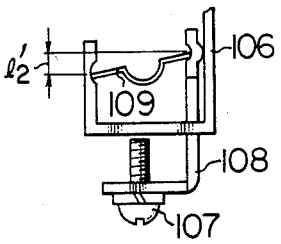

The embodiment according to the present invention is featured in that the position of the movable member 108 may be changed between two states depending on the length of the screw 107 or the height of the fixed spring-support portion 162*a* under the condition that the movable member 108 is not fastened by the screw 107, with the same shape and the same dimension of the movable member 108. That is, as shown in FIG. 6*a*, the terminal screw 107 is stably held at the lower limit position with the distance l1 between the tip end of the screw 5 and the lower surface of the terminal plate portion 161 and with the vertical length l2 of the spring 109, that is the distance in one direction from the fixed spring-support portion 162*a* to the movable spring-support portion 183*a*. Further, as shown in FIG. 6*b*, the terminal screw 107 is stably held at the lift-up position with no space between the tip end of the screw 107 and the lower surface of the terminal plate portion 161 and with the vertial length l2' of the spring 109, that is the vertical distance in the other direction from the fixed spring-support portion 162*a* to the movable spring-support portion 183*a*. A neutral point in which the horizontal length of the spring 109 is the shortest, that is the vertical distance between the fixed spring-support portion 162*a* and the movable spring-support portion 183*a* is zero, exists between the lower limit position and the lift-up position of the terminal screw 107. When the movable member is in a position under this neutral position, downward force acts onto the movable member 108 by the spring 109, while when it is at a position above the neutral position, upward force acts onto the same by the spring 109.

Accordingly, in use, the worker pull up first the movable member 108 into the state of FIG. 6*a* to insert a wire terminal thereto. Then, the movable member 108 is pushed up to be placed into the lift-up position of FIG. 6*b* in which the restoration force of the spring 109 acts onto the wire terminal in the direction to sandwich the wire terminal so that the screw 107 can be screwed by the worker without requiring any force against the force of the spring 109, and in which the force of the spring 109 continuously acts onto the screw in the direction of screwing the latter during the screwing operation, so that there is no possibility of coming-off of the screw due to vibrations, etc.

Referring to FIGS. 7 and 8, a third embodiment in which the present invention is applied to a terminal block will be described hereunder.

A terminal block 201 is made of a plastic material, and constituted by an insulating partition wall 202 for ensuring electrical insulation from any other terminal connector to be adjoined to this terminal block 201, a center partition wall 203 dividing the insulating partition wall 202 into left and right portions in the drawing, left and right end walls 204 and 205 provided at the left and right ends of the insulating partition wall 202 respectively, a rail mounting portion 206 provided at the lower portion of the insulating partition wall 202, a protrusion portion 207 for ensuring engagement with any other terminal connector to be adjoined to this terminal block 201, and a recess portion (not shown) formed at the rear side of the insulating partition wall 202 at a position corresponding to the protrusion portion 207 for the same purpose, all of which are integrally molded into the terminal block 201. A flat-rectangular electrical terminal plate 208 is supported by the center partition wall 203 and the left and right end walls 204 and 205. The terminal plate 208 is formed with screw holes 209*a* and 209*b* at its opposite ends and a slot 208*a* at its center portion adjoining the center partition wall 203 for allowing movable members 210*a* and 210*b* to pass therethrough. The movable members 210*a* and 210*b* are shaped to be symmetrical with each other as seen in FIG. 8. Description will be made as to the movable member 210*a*. The movable member 210*a* has a first or pushing portion 212 which is disposed parallelly with the terminal plate 208 and a second or vertical portion 212*a* perpendicularly extending from one end of the pushing portion 212. The pushing portion 212 is formed at its center portion with a hole in which a terminal screw 213 is rotatably held at its neck portion with a spring washer. The second or vertical portion 212*a* of the movable member 210*a* is provided at its free end a stopper portion 211 extending perpendicularly to the direction of movement of the movable member 210*a* and a movable spring-support V-shaped portion 211*a* is formed in this stopper portion. The pushing portion 212 is disposed above the terminal plate 208 and the stopper portion 211 is disposed under the same as seen in the drawing. Fixed spring-support V-shaped portion 215*a* and 215*b* are formed in the left and right end walls 204 and 205 at predetermined positions opposed to the movable spring-support portions of the respective movable members 210*a* and 210*b* such that they extend perpendicularly to the direction of movement of the respective movable members 210*a* and 210*b*. Compression springs 216*a* and 216*b* are supported between the fixed spring-support portions 215*a* and 215*b* and the movable spring-support portions 211*a* and 211*b* respectively.

In FIG. 7, the left side of the drawing shows the state in which not wire terminal is connected thereto, and in which the movable member 210*a* is in its upper limit position where the stopper portion 211 of the movable member 210*a* is in contact with the lower surface of the terminal plate 208 due to the restoration force of the spring 216*a*. In this upper limit position, the screw 213 is not removed from the pushing portion 212 of the movable member 210*a* and the tip end of the screw is in opposite to a screw hole 209*a* formed in the terminal plate 208. In FIG. 7, the right side of the drawing shows the state in which a wire terminal 217 is connected thereto. The wire terminal 217 is sandwiched between the terminal plate 208 and the pushing portion 212 and the movable member 210*b* has come near to its lower limit position. The operation of the movable members 210*a* and 210*b* are quite the same as that in the previous embodiments and therefore the description is omitted here.

As described above in detail with respect to various embodiments, according to the invention, a movable member is arranged to be stably held in two stable positions, that is an upper/lower limit position and a lowered/lifted-up position, so that when wires are to be connected to numbers of collectively provided terminal connectors, it is possible that all the movable members of all the terminal connectors are first placed in the state as shown in FIG. 3*a*, FIG. 6*a* or the left hand of FIG. 7, then wire terminals are successively inserted and held in the state as shown in FIG. 3*a* or FIG. 6*a*, and finally the screws are fastened one by one. Thus, the wire terminal connecting work can be easily performed even in the case of numbers of collectively provided wire terminal connectors.

According to the present invention, the shape of the compression spring is not restricted to that illustrated in the embodiments but various springs of various shapes and various arrangement such as (a) a plate spring, (b) a plate spring longitudinally formed with a slot at its center portion, (c) a loop wire spring, (d) a wire spring having opposite free ends, (e) a double coiled wire spring, (f) a rectangularly-shaped wire spring, etc.

It is a matter of course that the present invention can be applied not only to such a socket, a switch, and a terminal block as described in the embodiments, but to any other electric device which has a wire terminal connecting portion at which a wire terminal is attached by a terminal screw and a screw hole.

We claim:

1. A wire terminal connector for use in an electric device, comprising an electrically conductive terminal plate formed with at least one screw hole, and at least one terminal screw to be screwed into said screw hole, for fixing a wire terminal between said terminal plate and said terminal screw, in which said terminal connector further comprises:

a movable member slidably supported for movement perpendicularly to said terminal plate, said movable member including a first portion extending parallell with said terminal plate and having means for supporting said terminal screw, and a second portion integrally formed with said first portion and extending perpendicularly to said first portion from one end of said first portion, said second portion having a stopper portion for limiting said first portion to a range of movement relative to said terminal plate, said first portion being movable between a first position in which a threaded end of said terminal screw is spaced a predetermined distance away from said terminal plate and opposed to said screw hole and a second position in which said threaded screw end is adjacent said terminal plate and opposed to said screw hole;

a compression spring with one end supported by said second portion of said movable member; and a fixed spring-support means for supporting said compression spring at the other end thereof so that said first portion is stably held in at least said first position with said threaded screw end spaced said predetermined distance away from said terminal plate by a restoration force of said compression spring.

2. A wire terminal connector according to claim 1, in which the shape of said stopper portion is rectangular.

3. A wire terminal connector according to claim 1, in which said terminal screw is stably held at a selected one of at least two, a first and a second, stable positions, said first and second positions having the largest and smallest distances from said terminal plate respectively.

4. A wire terminal connector according to claim 1, in which said terminal plate has a portion integrally formed therewith and perpendicularly extending from one end of thereof, said fixed spring-support means being formed at an end portion of said perpendicularly extending portion of said terminal plate.

5. A wire terminal connector according to claim 1, in which said terminal plate has a first portion formed with said screw hole, a second portion perpendicularly extending from one end of said first portion formed with said fixed spring-support means at its free end portion, and a third portion extending parallelly with said second portion so as to define a space surrounded by said first, second and third portions, and in which a slot is formed continuously in said first and third portion of said terminal plate and said second portion of said movable member is inserted through said slot into said space so that said spring supported between said second portion of said terminal plate and said second portion of said movable member urges the latter against said third portion of said terminal plate, and in which said slot has a width narrower than a length of said stopper portion of said movable member so that movement in one direction is restricted by the contact of said stopper portion with said first portion of said terminal plate.

6. A wire terminal connector according to claim 1, in which said connector comprises an insulating body formed with a recess, said terminal plate being fixedly supported by said body at an opening of said recess, said fixed spring-support means being formed at a portion of an inner wall of said recess.

7. A wire terminal connector according to claim 1, in which said connector comprises an insulating body formed with a recess, said terminal plate being fixedly supported by said body at an opening of said recess, said fixed spring-support means being formed at a portion of a first inner wall of said recess, and in which a slot is formed in said terminal plate and said second portion of said movable member is inserted through said slot into said recess so that said spring supported between said fixed spring-support means and said second portion of said movable member urges the latter against another inner wall of said recess opposed to said first inner wall, and in which said slot has a width narrower than a length of said stopper portion of said movable member so that movement in one direction of said movable member is restricted by the contact of said stopper portion with said terminal plate.

8. A wire terminal connector according to claim 1, in which said electric device is in the form of a socket.

9. A wire terminal connector according to claim 1, in which said electric device is in the form of a switch.

10. A wire terminal connector according to claim 1, in which said electric device is in the form of a terminal block.

11. A wire terminal connector according to claim 1 in which said first portion is stably held in said second position with said threaded screw end adjacent said terminal plate by a restoration force of said compression spring.

12. A wire terminal connector for use in an electric device, comprising an electrically conductive terminal plate formed with at least one screw hole, and at least one terminal screw to be screwed into said screw hole, for fixing a wire terminal between said terminal plate and said terminal screw, in which said terminal connector further comprises:

a movable member slidably supported for movement perpendicularly to said terminal plate, said movable member including a first portion extending parallell with said terminal plate and having means for supporting said terminal screw, and a second portion integrally formed with said first portion and extending perpendicularly to said first portion from one end of said first portion, said second portion having a stopper portion for limiting said first portion to a range of movement relative to said terminal plate;

a compression spring with one end supported by said second portion of said movable member; and, a fixed spring-support means for supporting said compression spring at the other end thereof so that said terminal screw is stably held in at least one stable position at a predetermined distance away from said terminal plate;

said terminal plate having a first portion formed with said screw hole, a second portion perpendicularly extending from one end of said first portion and formed with said fixed spring-support means at a free end portion, and a third portion extending parallell with said second portion so as to define a space surrounded by said first, second and third portions;

said first and third portions of said terminal plate having a slot formed continuously therein, and said second portion of said movable member being inserted through said slot into said space so that said spring supported between said second portion of said terminal plate and said second portion of said movable member urges the latter against said third portion of said terminal plate; and, said slot having a width narrower than a length of said stopper portion so that movement of said movable member in one direction is limited by contact of said stopper portion with said first portion of said terminal plate.

13. A wire terminal connector for use in an electric device, comprising an electrically conductive terminal plate formed with at least one screw hole, and at least one terminal screw to be screwed into said screw hole, for fixing a wire terminal between said terminal plate and said terminal screw, in which said terminal connector further comprises:

a movable member slidably supported for movement perpendicularly to said terminal plate, said movable member including a first portion extending parallell with said terminal plate and having means for supporting said terminal screw, and a second portion integrally formed with said first portion and extending perpendicularly to said first portion from one end of said first portion, said second portion having a stopper portion for limiting said first portion to a range of movement relative to said terminal plate;

a compression spring with one end supported by said second portion of said movable member;

a fixed spring-support means for supporting said compression spring at the other end thereof so that said terminal screw is stably held in at least one stable position at a predetermined distance away from said terminal plate; and, an insulating body formed with a recess, said terminal plate being fixedly supported by said body at an opening of said recess and said fixed spring-support means being formed at a portion of a first inner wall of said recess;

said terminal plate having a slot formed therein, and said second portion of said movable member being inserted through said slot into said recess so that said spring supported between said fixed spring-support means and said second portion of said movable member urges the latter against another inner wall of said recess opposed to said first inner wall; and, said slot having a width narrower than a length of said stopper portion so that movement of said movable member in one direction is limited by contact of said stopper portion with said terminal plate.

* * * * *